US011446920B2

(12) United States Patent
Littler

(10) Patent No.: US 11,446,920 B2
(45) Date of Patent: Sep. 20, 2022

(54) APPARATUS AND METHOD FOR MOUNTING A FLEXIBLE PLATE

(71) Applicant: JM HEAFORD LIMITED, Altrincham (GB)

(72) Inventor: Graham Littler, Kingsmead (GB)

(73) Assignee: JM HEAFORD LIMITED, Altrincham (GB)

( * ) Notice: Subject to any disclaimer, the term of this patent is extended or adjusted under 35 U.S.C. 154(b) by 887 days.

(21) Appl. No.: 15/754,949

(22) PCT Filed: Apr. 5, 2016

(86) PCT No.: PCT/GB2016/050959
§ 371 (c)(1),
(2) Date: Feb. 23, 2018

(87) PCT Pub. No.: WO2017/032966
PCT Pub. Date: Mar. 2, 2017

(65) Prior Publication Data
US 2020/0238685 A1 Jul. 30, 2020

(30) Foreign Application Priority Data
Aug. 25, 2015 (GB) ..... 1515088.1

(51) Int. Cl.
*B41F 27/12* (2006.01)
*B41F 27/00* (2006.01)
*B41F 27/14* (2006.01)

(52) U.S. Cl.
CPC ..... *B41F 27/005* (2013.01); *B41F 27/1206* (2013.01); *B41F 27/1275* (2013.01);
(Continued)

(58) Field of Classification Search
CPC ..... B41F 27/005; B41F 27/1206; B41F 27/1275; B41F 27/14; B41P 2227/11; B41P 2227/62
See application file for complete search history.

(56) References Cited

U.S. PATENT DOCUMENTS 4,451,309 A 5/1984 Cauldwell
4,611,539 A 9/1986 Ireton
(Continued)

FOREIGN PATENT DOCUMENTS

DE 3614554 A1 11/1987
DE 19838777 A1 3/2000
(Continued)

OTHER PUBLICATIONS

International Search Report PCT/GB2016/050959 filed on Apr. 5, 2016.
Written Opinion of PCT/GB2016/050959 filed on Apr. 5, 2016.

*Primary Examiner* — Leslie J Evanisko
(74) *Attorney, Agent, or Firm* — Notaro, Michalos & Zaccaria P.C.

(57) ABSTRACT

An apparatus for mounting a flexible plate onto a print sleeve or cylinder, where the apparatus has at least two manipulator units located below the print sleeve or cylinder and support members provided on each manipulator unit and each support member has a curved profile for arching the flexible plate prior to its mounting onto the print sleeve or cylinder, is disclosed.

18 Claims, 14 Drawing Sheets

(52) U.S. Cl.
CPC ..... *B41F 27/14* (2013.01); *B41P 2227/11* (2013.01); *B41P 2227/62* (2013.01)

(56) References Cited

U.S. PATENT DOCUMENTS

| | | | | | |
|---|---|---|---|---|---|
| 5,155,921 | A | | 10/1992 | Banike | |
| 5,331,893 | A | * | 7/1994 | Wieland | B41F 27/1206 101/481 |
| 5,488,781 | A | | 2/1996 | Van Der Horst | |
| 5,676,058 | A | | 10/1997 | Ireton | |
| 6,450,096 | B1 | * | 9/2002 | Koppelkamm | B41F 27/1206 101/389.1 |
| 8,201,499 | B2 | * | 6/2012 | Fujishiro | B41F 27/1206 101/477 |
| 2010/0229747 | A1 | * | 9/2010 | Ballreich | B41F 27/1206 101/477 |
| 2014/0230674 | A1 | | 8/2014 | Sanger | |
| 2014/0326152 | A1 | | 11/2014 | Gartner | |

FOREIGN PATENT DOCUMENTS

| | | | |
|---|---|---|---|
| EP | 0222033 | A1 | 5/1987 |
| GB | 2490029 | A | 10/2012 |

* cited by examiner

APPARATUS AND METHOD FOR MOUNTING A FLEXIBLE PLATE

TECHNICAL FIELD OF THE INVENTION

The present invention relates to an apparatus and to a method for mounting a flexible plate onto a print sleeve or cylinder.

BACKGROUND TO THE INVENTION

In the printing industry flexographic plates formed on one surface with a relief print have to be mounted with accuracy, either directly onto press cylinders (hereafter cylinder(s)) or onto cylindrical print sleeves (hereafter sleeve(s)) mounted on rotatable mandrels.

The accuracy of mounting is particularly important when mounting photopolymer printing plates where the colours of an image (yellow, red, blue (cyan), black etc.) are overlaid to produce the finished image. Thus, the mounting operation has to be repeated with precision for each of the plates carrying the image portions for each colour, with four colours being typical. Registration marks, usually crosses or dots, are often provided on each printing plate to promote accurate alignment of the printing plates with the cylinder or sleeve.

The printing plate may then be applied onto the cylinder or sleeve from above by draping the printing plate over the sleeve or cylinder manually, as is common in the case when applying printing plates onto sleeves or cylinders.

Alternatively, the printing plate may be offered up tangentially to the top of the sleeve or cylinder from a flat support table. Cameras are often provided above the sleeve or cylinder and are operatively linked to a display screen that provides the operator with magnified images of the registration marks on the printing plate. This enables the operator to align the registration marks on the printing plate with markings on the sleeve or cylinder with greater accuracy. The printing plate is then mounted onto the sleeve or cylinder and double sided adhesive tape, previously applied to the sleeve or cylinder is used to secure the printing plate thereto. Such an apparatus and method is known from U.S. Pat. No. 5,488,781 A.

When printing plates are supported on a flat support table, as is the case in U.S. Pat. No. 5,488,781 A, edges of the printing plate are known to curl and lay in an uneven manner with raised portions visible as the plate lies in its natural state. This can lead to a reduction in the accuracy of alignment between the printing plate and the printing cylinder. The operator may also experience difficulties in mounting the printing plate to the printing cylinder when the edges of the printing plate are curled, thereby reducing the speed and efficiency of the mounting operation. A further disadvantage of conventional support tables is that they are typically constructed from painted mild steel, stainless steel or aluminium. Although these materials generally have a uniform and smooth surface finish, they nevertheless induce drag as a printing plate of rubber or polymer material is moved across the support table. This imparts a significant resistance to movement and increases the risk that the printing plate will not be positioned correctly.

Despite these disadvantages, apparatuses of this type are widely used throughout the print industry.

It is an object of embodiments of the present invention to provide an apparatus and method which avoids the disadvantages mentioned above.

It is another object of embodiments of the present invention to provide an apparatus and method for mounting a printing plate onto a sleeve or cylinder with greater ease.

It is a further object of embodiments of the present invention to provide an apparatus and method which improves the accuracy and repeatability of registration between the printing plate and a sleeve or cylinder.

SUMMARY OF THE INVENTION

According to a first aspect of the present invention there is provided an apparatus that comprises at least two manipulator units located below the print sleeve or cylinder and support members provided on each manipulator unit, with each support member having a curved profile for arching the flexible plate prior to its mounting onto the print sleeve or cylinder.

This arrangement was found to be particularly suitable for mounting a flexible plate onto a sleeve or cylinder with increased accuracy. The use of curved support members (as opposed to a flat support table) forces the flexible plate into an arched profile. This has the effect of increasing surface tension at the crown of the curvature such that the flexible plate is both straightened and strengthened axially. This effect may be enhanced further by laying the flexible plate in an inverted manner over the curved support member. This in turn allows the flexible plate to be positioned with greater accuracy prior to and during mounting of the flexible plate onto the sleeve or cylinder. By forcing the flexible plate into an arched profile, it was found that the natural curl of edges and surface distortion of the flexible plate could be eliminated.

The apparatus may comprise a manipulator deck having a profile for providing additional support to the arched flexible plate. This helps maintain the flexible plate's arched shape during plate positioning and mounting operations, resulting in improved alignment between the flexible plate and the sleeve or cylinder. Preferably, the manipulator deck has a substantially curved profile. The manipulator deck may comprise a surface for reducing friction between the flexible plate and the manipulator deck as the flexible plate is moved axially along the manipulator deck by the manipulator units.

Preferably the manipulator deck comprises a dimpled surface for reducing friction between the flexible plate and the manipulator deck. More preferably the manipulator deck comprises a raised dimpled surface. The use of a raised dimpled surface was found to reduce surface contact between the manipulator deck and the flexible plate by more than 90%, meaning that improvements in plate transport and positioning can be obtained.

Alternatively, each manipulator unit may comprise plate support wings and each plate support wing preferably comprises a dimpled surface. The dimpled surface may cover the whole of the wing or cover only part of the wing. The support wings may be removably attached to a manipulator unit using suitable fastening means and each wing is preferably adapted to follow the profile shape of the manipulator deck.

In a preferred embodiment a rectangular body extends between the plate support wings. The rectangular body is preferably adapted to extend across the manipulator deck below the manipulator unit and may be used as an attachment point for attaching the plate support wings to each manipulator unit. The support wings are preferably positioned above the manipulator deck walls with the dimpled surface preferably facing away from the manipulator deck. In this way the plate support wings can freely move along the sleeve axis with the manipulator unit. The plate support wings may be formed by bending the rectangular body until a shape that conforms to the profile of the manipulator deck is obtained.

Each support member may comprise a resilient material. The support member may be a platen having an upper surface layer that comprises the resilient material. Suitable resilient materials for use in the present invention include but are not limited to rubber and synthetic polymers such a polyurethanes.

The support members may comprise one or more apertures. The provision of one or more apertures (viewing holes) enables the operator to view registration marks present on the inverted flexible plate once the flexible plate has been applied onto the support member. The manipulator units may comprise a camera or other digital device operatively connected to a display screen, with each camera or other digital device being oriented upwards for viewing the registration marks on the flexible plate. Preferably the display screen is a split display screen so that the registration marks located at opposite ends of the flexible plate can be viewed simultaneously.

Each manipulator unit may comprise a motor for adjusting the position of each manipulator unit in an axial direction and the position of each manipulator unit may be preprogrammed into a video recognition control system. Accordingly, the position of each manipulator unit may be controlled independently.

Each manipulator unit may also comprise a motor for adjusting the position of the support member in a radial direction. Each manipulator unit is preferably programmed to seek and find the registration marks present on the flexible plate. Accordingly, the position of each manipulator unit can be adjusted automatically until each manipulator unit is appropriately aligned with its target registration mark on the inverted flexible plate. The alignment of each manipulator unit with the registration marks on the inverted flexible plate may be confirmed by the operator by visual inspection of the display screen.

Once the manipulator units are appropriately aligned a vacuum may be applied for temporarily securing the flexible plate to the support member by vacuum means. Accordingly, each manipulator unit may comprise its own means for generating a vacuum. Preferably the vacuum means is in the form of a vacuum suction device mounted below the support member. By using a vacuum to temporarily hold the flexible plate on the support member, alignment of the flexible plate with the manipulator units and the sleeve or cylinder can be maintained during plate positioning and mounting operations respectively.

The manipulator deck may comprise a motor for moving the manipulator deck between raised and lowered positions in a direction perpendicular to the axis of the print sleeve or cylinder. Once the position of the manipulator units has been optimised and the flexible plate has been transported axially to a pre-determined position below the sleeve or cylinder, the manipulator deck may be motor driven towards the sleeve or cylinder until contact (line contact) is made between the flexible plate and the sleeve or cylinder.

The sleeve or cylinder may comprise double sided adhesive tape for securing the flexible plate to the sleeve or cylinder.

The apparatus may comprise a roller for rolling the flexible plate onto the print sleeve or cylinder. Preferably the roller comprises a resilient material such as rubber.

According to a second aspect of the invention there is provided a method for mounting a flexible plate onto a print sleeve or cylinder, the method comprising the steps of:

providing a sleeve or cylinder;

providing a flexible plate having a relief surface;

applying the flexible plate onto a support member, wherein the relief surface of the flexible plate faces the support member (inverted) and wherein the support member is located below the sleeve or cylinder and has a curved profile for arching the flexible plate;

aligning the arched flexible plate with the sleeve or cylinder, and mounting the flexible plate onto the sleeve or cylinder.

The apparatus according to the first aspect of the invention is very suitable for carrying out the method according to the second aspect of the invention. The method according to the second aspect of the invention may therefore, as appropriate, incorporate any or all of the features described in relation to the apparatus according to the first aspect of the invention.

As described previously the flexible plate may be applied onto at least two support members, with the relief surface facing each support member. It has been found that improved accuracy when aligning the flexible plate with the sleeve or cylinder could be obtained by providing the flexible plate onto at least two support members having a curved profile, as opposed to providing the flexible plate on a single supporting surface such as a flat table.

Each support member may be mounted onto a manipulator unit, and the position of each manipulator unit may be independently adjusted axially to align the manipulator units with registration marks present on the arched flexible plate. Where appropriate, the position of each support member may also be independently adjusted in a radial direction. In this way, improved alignment between the manipulator units and the registration marks on the flexible plate can be obtained.

The alignment of each manipulator unit with the registration marks on the arched flexible plate may be carried out using an automated process. The automated process may be controlled by video recognition software or algorithms. This has been found to increase the accuracy and repeatability of the alignment between the manipulator units and the flexible plate, which in turn increases the accuracy and repeatability of alignment between the flexible plate and the sleeve or cylinder. A further advantage of using an automated process is that the process is less labour intensive. Automation also reduces operating costs. It also removes human error which improves the repeatability and the reliability of the mounting operation. While less preferred, flexible plates can still be applied onto the manipulator units and their position adjusted by manual operation if so desired. The method may comprise the step of applying the flexible plate onto the support members and then axially transporting the flexible plate to a first mounting position below the sleeve or cylinder. This means that the operator would no longer have to move the sleeve or cylinder along during the mounting operation, which is particularly advantageous when very wide print sleeves are being used. Alternatively, and when smaller sleeves or cylinders are being employed, the manipulator units may be moved to a first mounting position below the print sleeve or cylinder before the flexible plate is applied onto the support members.

Irrespective of whether the position of the arched flexible plate is adjusted manually or whether the position of the manipulator units are adjusted automatically with respect to the arched flexible plate, the alignment of each manipulator unit with the registration marks present on the arched flexible plate can be confirmed by visual inspection of the display screen. Adjustment of the position of the arched flexible plate or the manipulator units can be made as required.

The manipulator units may together move the arched flexible plate to a first mounting position below the print sleeve or cylinder. The axial transport of the arched flexible plate by the manipulators may be carried out using an automated process. The flexible plate may also be temporarily secured to the surface of the support member by vacuum means during the positioning and/or mounting of the flexible plate to the sleeve or cylinder.

To mount the flexible plate to the sleeve or cylinder a first part of the flexible plate may be brought into contact with the sleeve or cylinder by moving the manipulator units in a direction substantially perpendicular to the axis of the sleeve or cylinder until contact between the first part of the flexible plate and the sleeve or cylinder is made. Thereafter, a second part of the flexible plate may be mounted onto the sleeve or cylinder using a roller. Preferably the roller is made of or comprises a resilient material such as rubber.

According to a third aspect of the invention there is provided an apparatus for mounting a flexible plate onto a print sleeve or a press cylinder, a manipulator unit located below the print sleeve or press cylinder and a support member provided on the manipulator unit, wherein the support member has a curved profile for arching the flexible plate prior to its mounting onto the print sleeve or press cylinder.

The apparatus according to the third aspect of the invention may, as appropriate, incorporate any or all of the features described in relation to the apparatus according to the first aspect of the invention.

DETAILED DESCRIPTION OF THE INVENTION

In order that the invention may be more clearly understood an embodiment thereof will now be described, by way of example only, with reference to the accompanying drawings, of which:

FIG. 1 shows a perspective view of a plate positioning and mounting apparatus according to the present invention.

FIGS. 2A-B show perspective views of a manipulator unit according to the present invention.

FIGS. 6A-G show perspective views of the plate positioning and mounting apparatus in use when mounting a flexible plate onto a sleeve.

Figure 7:
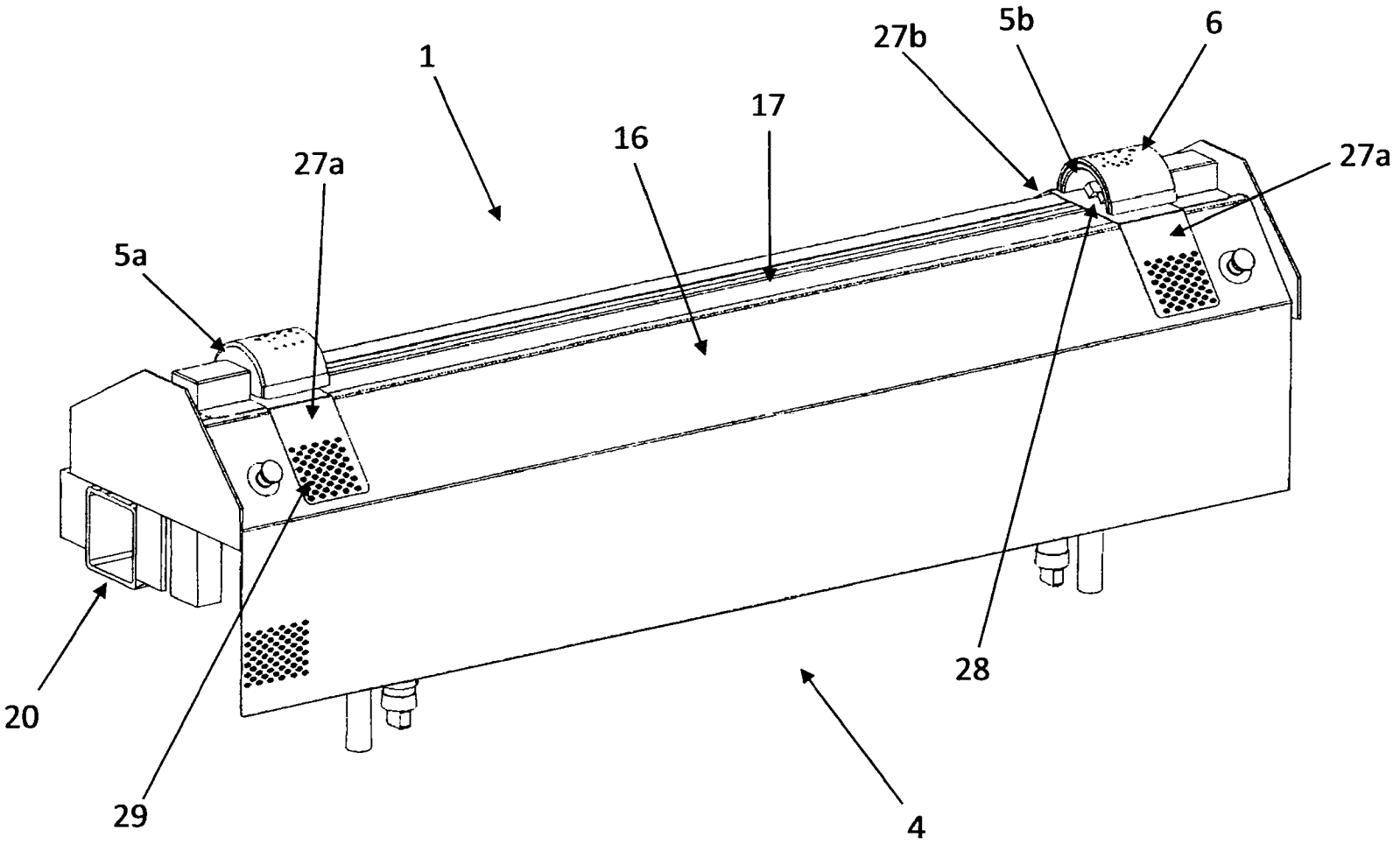

FIG. 7 shows a perspective view of the plate positioning and mounting apparatus with plate support wings.

Figure 1:
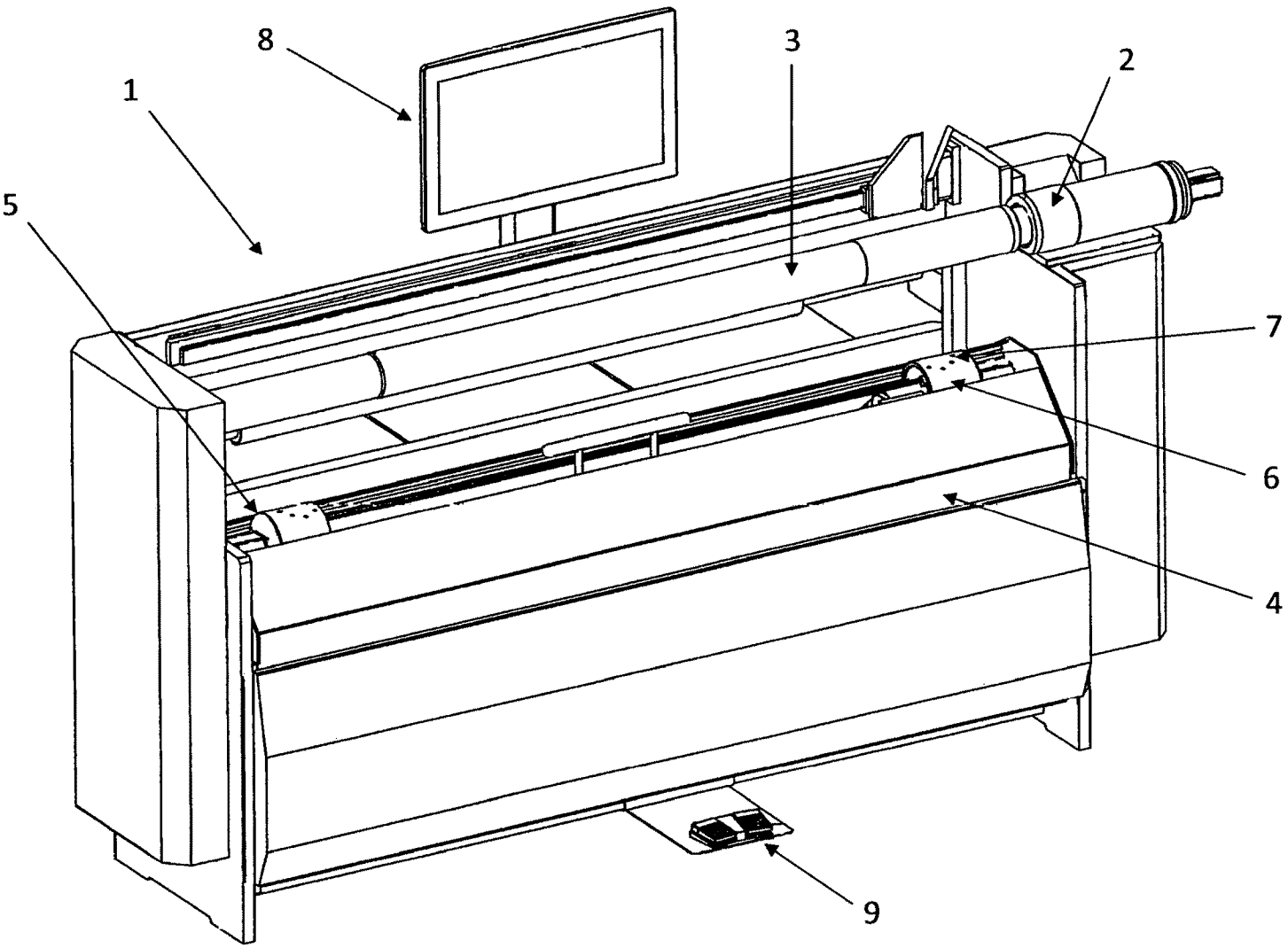

FIG. 1 shows a plate positioning and mounting apparatus 1 according to the present invention. The apparatus 1 is provided with a rotatable mandrel 2 that supports a removable sleeve 3. Provided below mandrel 2 and sleeve 3 is a manipulator deck 4 that houses a pair of manipulator units 5. A support member 6 is mounted onto each manipulator unit 5, with each support member 6 comprising a plurality of apertures 7. Each manipulator unit 5 comprises a camera (not shown) located below its respective support member 6, said camera being oriented through an aperture 7 in the direction of mandrel 2 for viewing registration marks (not shown) on a flexible plate (not shown) applied onto the support member 6. The apparatus 1 further comprises a roller (not shown) for rolling the flexible plate onto the sleeve 3, a display screen 8 operatively connected to the camera and a foot control 9 for manual intervention.

Figure 2A:
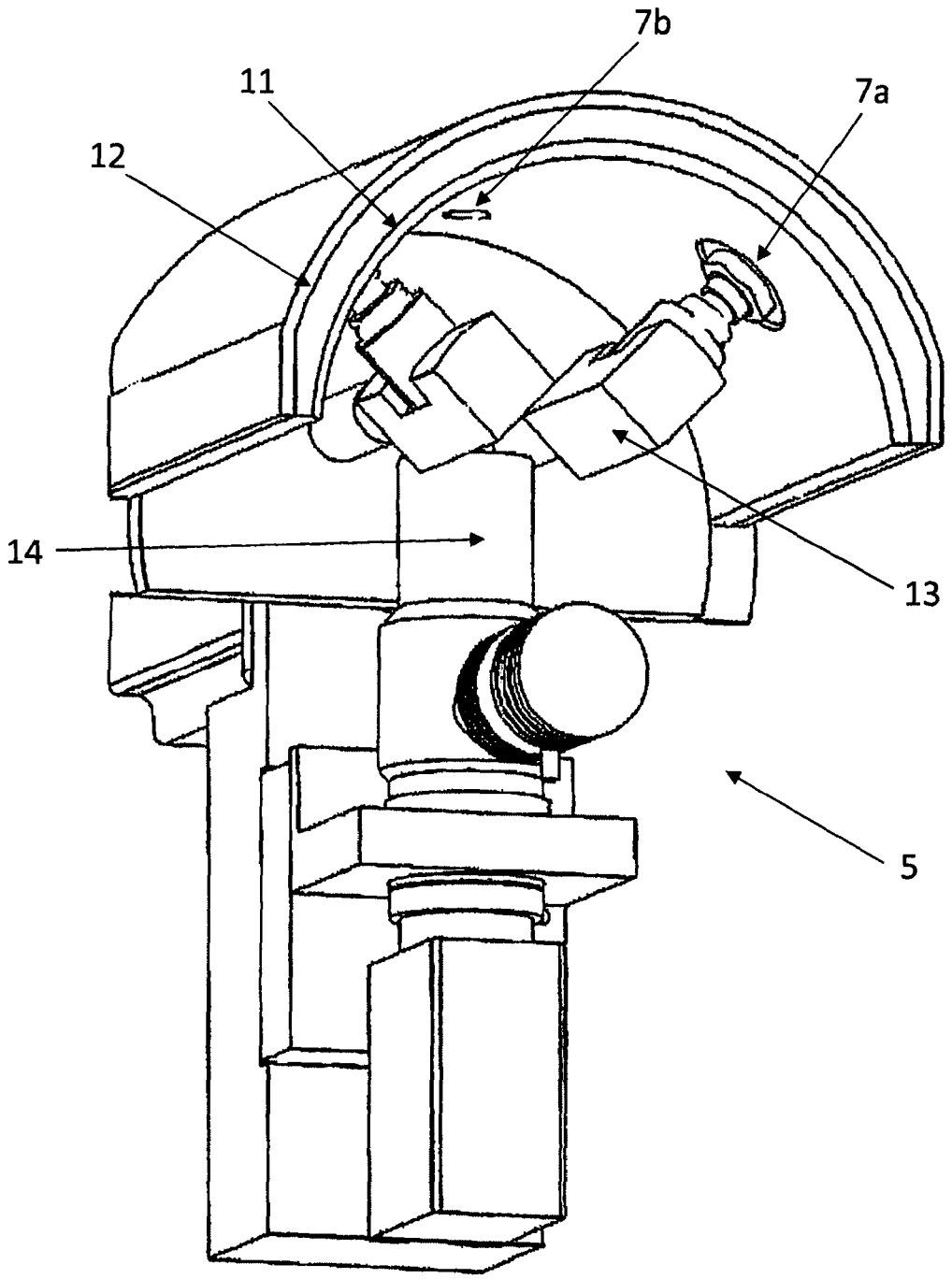
Figure 2B:
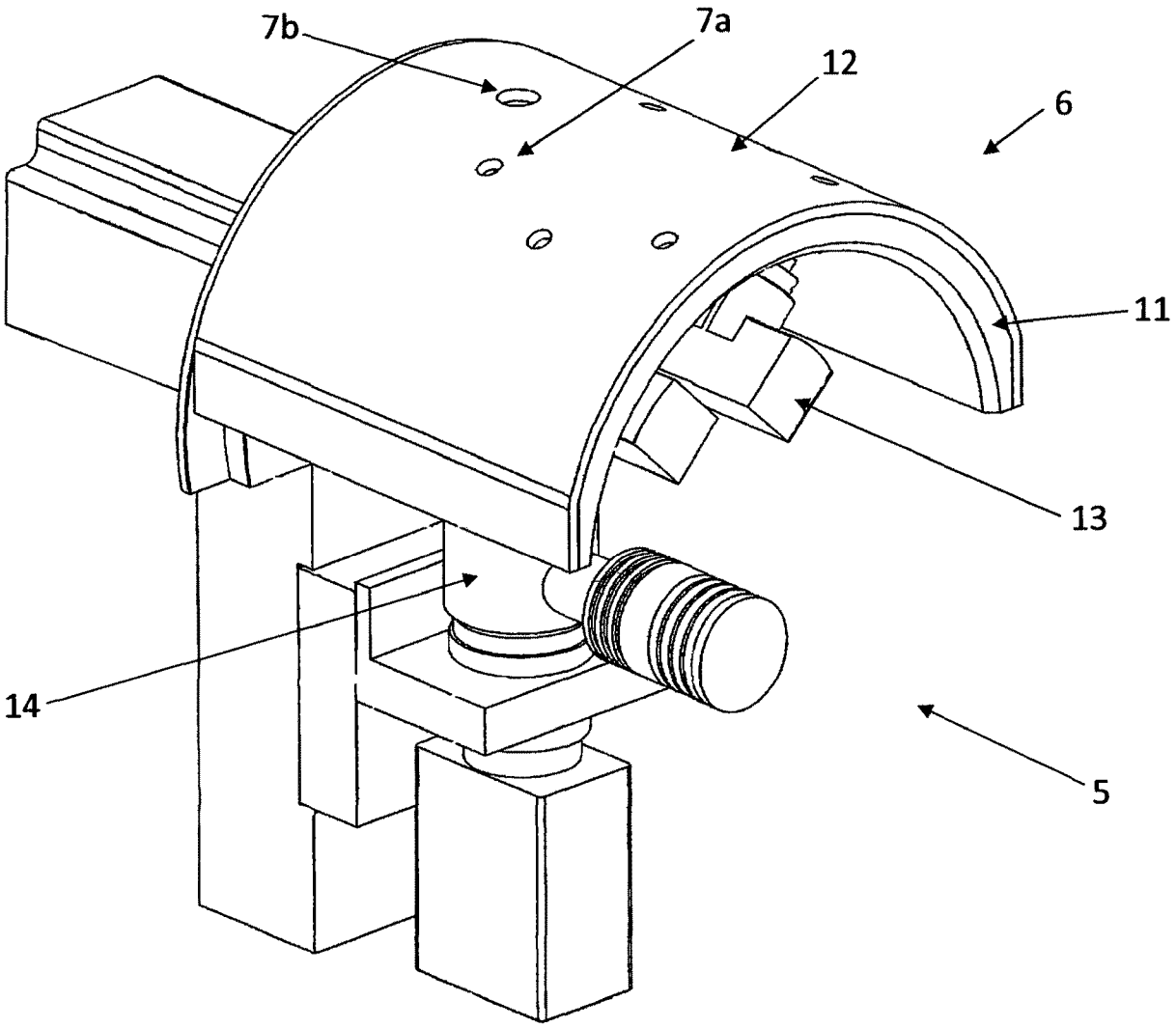

FIGS. 2A-B show a manipulator unit 5. The support member 6 has a curved profile for supporting and arching a flexible plate 10. The support member 6 in the form of a platen comprises a metal plate member 11, the upper surface of which is provided with a layer of a resilient material 12 such as rubber. The support member 6 is provided with apertures 7*a*, which in use, enable the flexible plate 10 to be temporarily secured to the support member 6 by vacuum means 13. The support member 6 comprises a further aperture 7*b* that functions as a viewing hole for a camera 14 so that registration marks (not shown) on the flexible plate 10 may be viewed and aligned with the manipulator unit 5 by using an automated alignment process.

Figure 3:
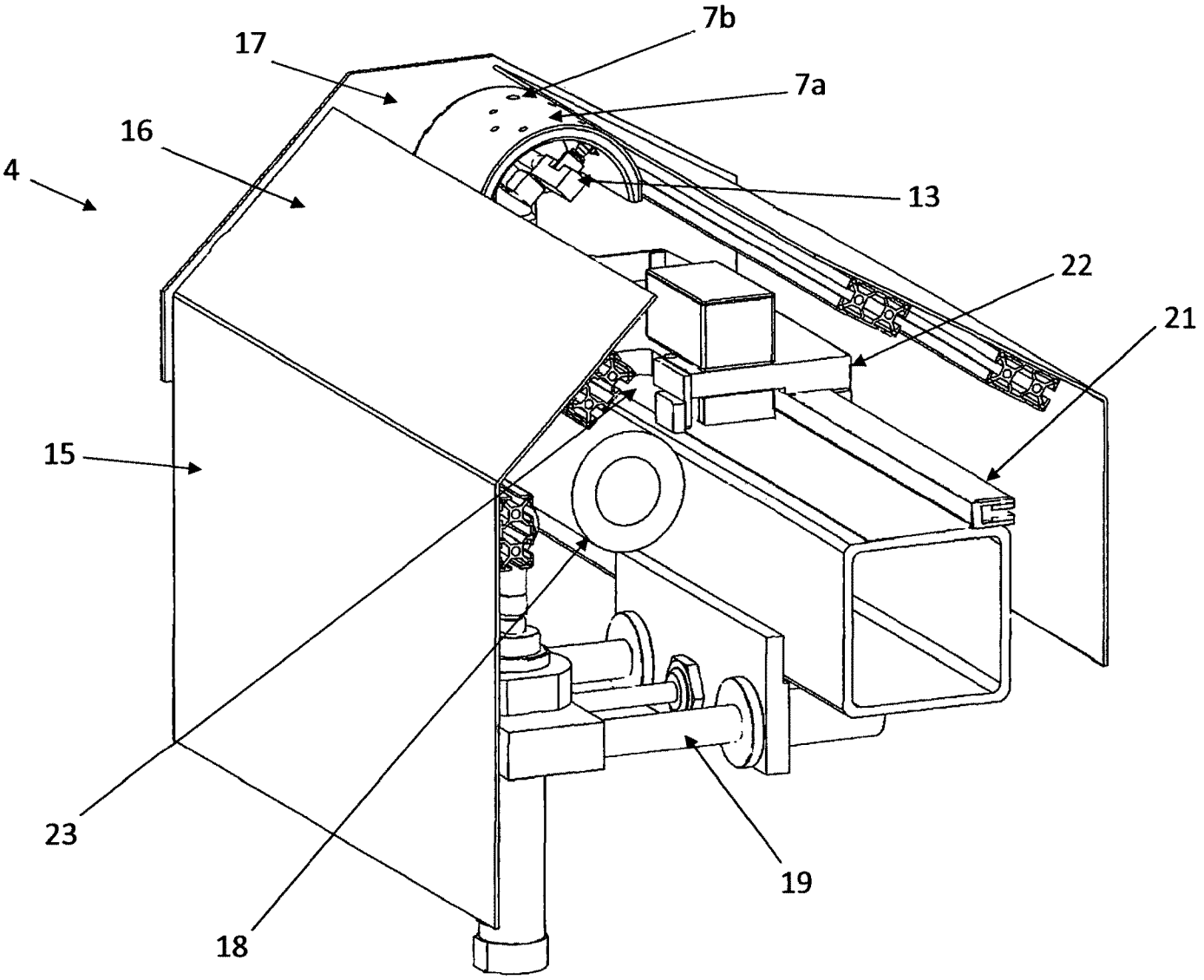
FIG. 3 shows a perspective cut away view of the manipulator deck according to the present invention.
Figure 4:
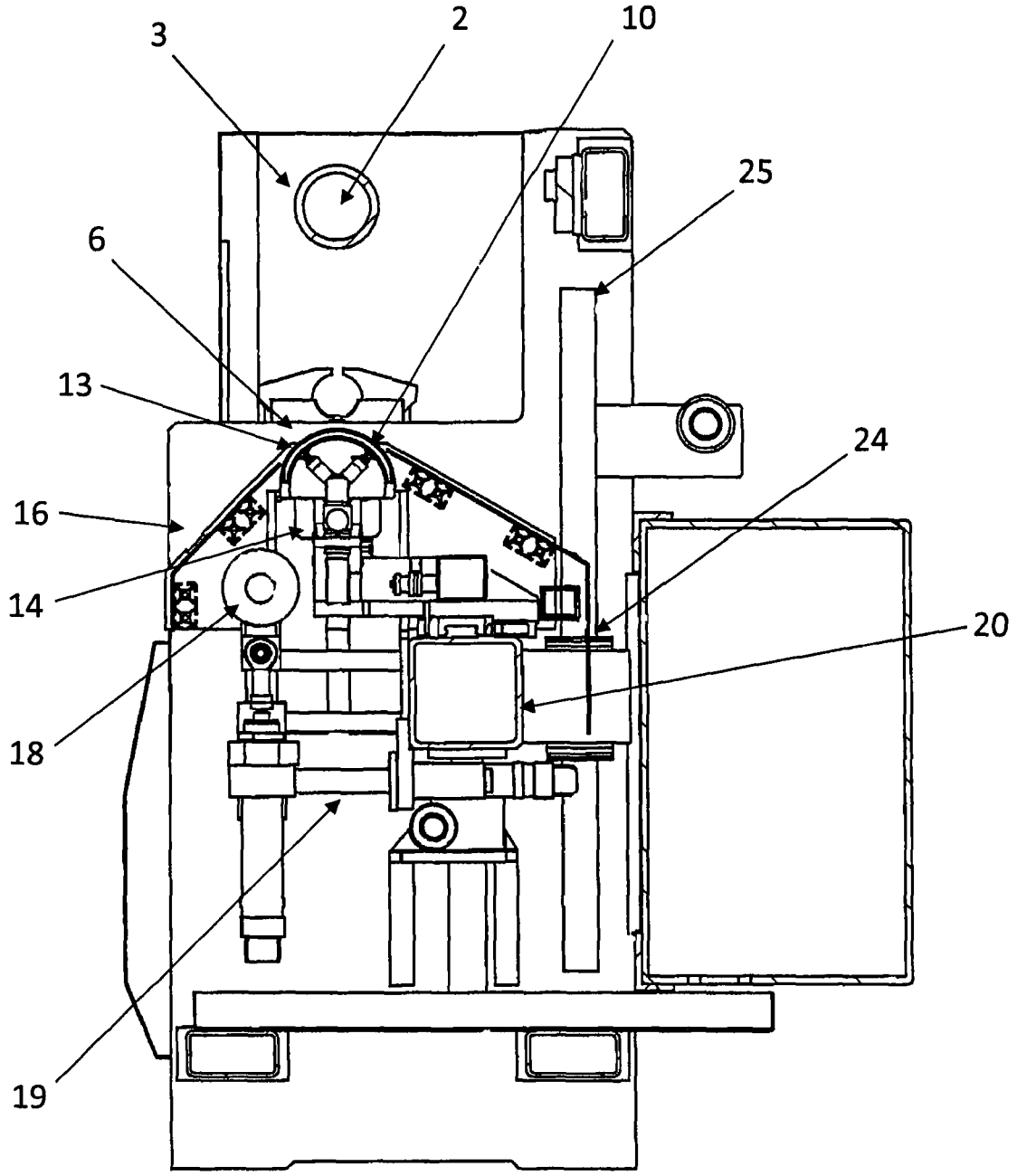
FIG. 4 shows a cross-sectional view of the manipulator deck in its lowered position.
Figure 5:
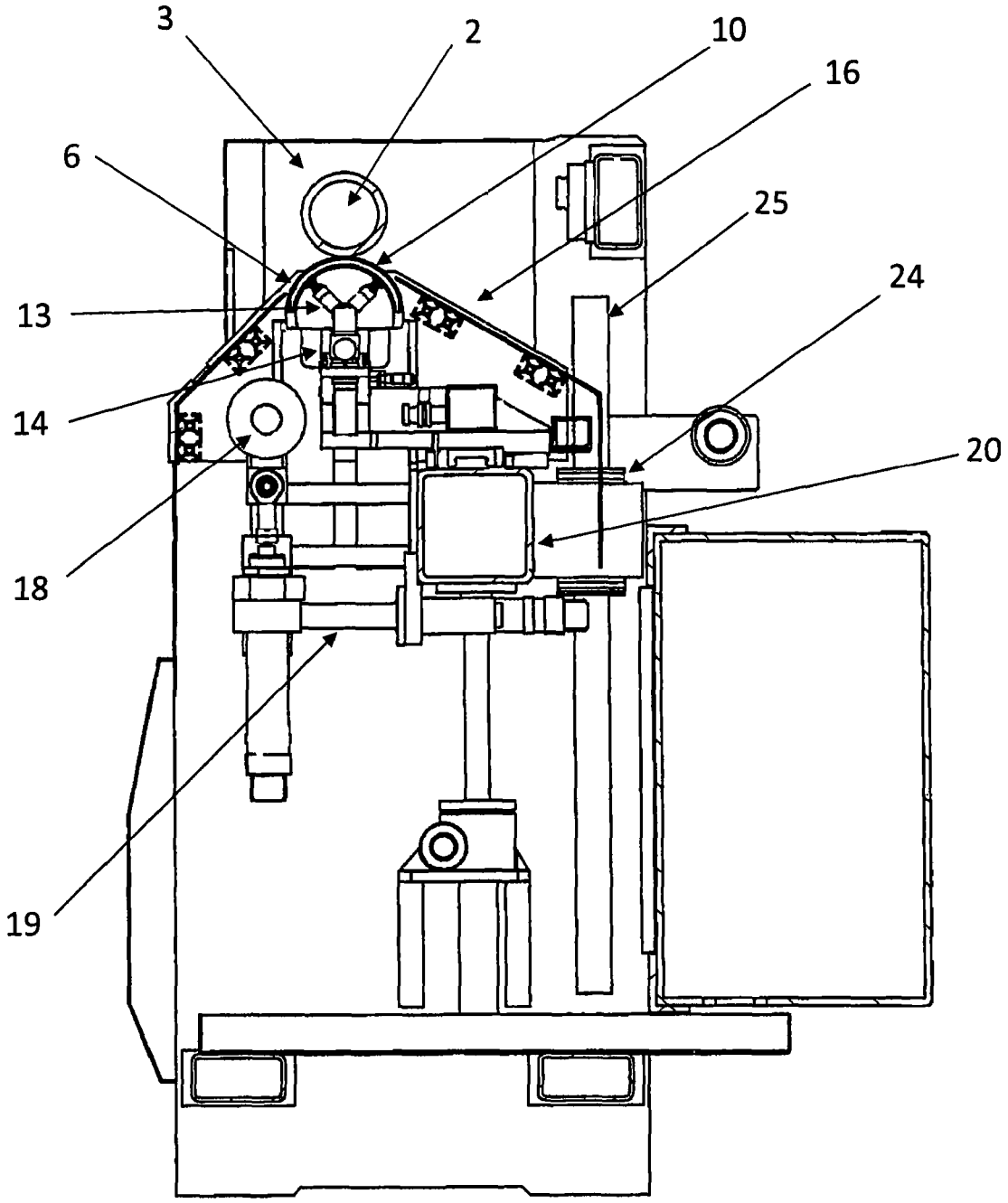
FIG. 5 shows a cross-sectional view of the manipulator deck in its raised position.

FIG. 3 shows a perspective view of the manipulator deck 4. The manipulator deck comprises a body 15. The body 15 comprises walls 16, the upper parts of which extend radially inwards to define a gap 17. The body 15 has a profile that is suitable for maintaining the arched profile of the flexible plate 10 once it has been applied onto support member 6. A roller 18 in its parked position is located under the radially inwardly extending wall 16 and is programmed to move along a programmed path, horizontally and in a direction perpendicular to the axis of the mandrel 2, with the position of the roller being controlled by a plurality of pneumatic or electric actuators 19. The manipulator deck further comprises a hollow body 20 that extends along the longitudinal axis of the manipulator deck 4. The hollow body 20 having a substantially square cross-section supports a guide rail 21. The guide rail 21 extends substantially along the length of the hollow body 20. Mounted onto to the guiderail 21 is a platform 22 that is axially movable along the guiderail 21. As best shown in FIGS. 4 and 5, the platform 22 is connected to the manipulator unit 5 via an axially extending arm 23. This enables the manipulator unit 5 to move axially along the guiderail 21 as required during positioning and mounting operations.

FIGS. 4 and 5 both show cross-sectional views of the manipulator deck 4. The manipulator deck 4 is fixed to a collar 24 that is slidably moveable along a beam 25 that extends upwardly in a direction substantially perpendicular to the axis of the mandrel 2. This assembly allows the manipulator deck 4 to be moved between lowered (as shown in FIG. 4) and raised positions (as shown in FIG. 5) as required. The manipulator deck may be lowered and raised automatically by a motor.

FIGS. 6A-G show perspective views of the plate positioning and mounting apparatus 1 in use when mounting a flexible plate 10 onto a sleeve 3.

Figure 6A:
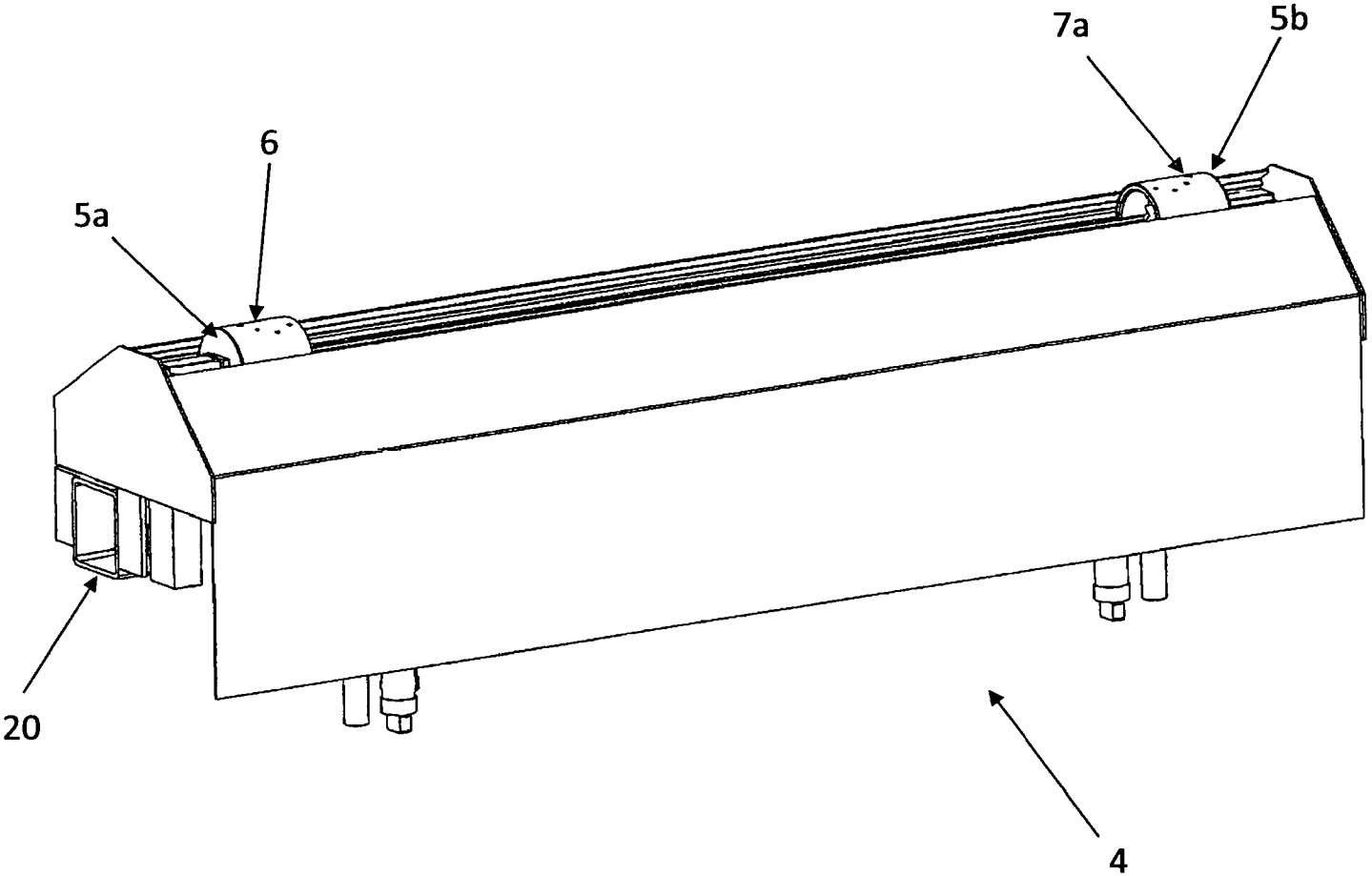
Figure 6B:
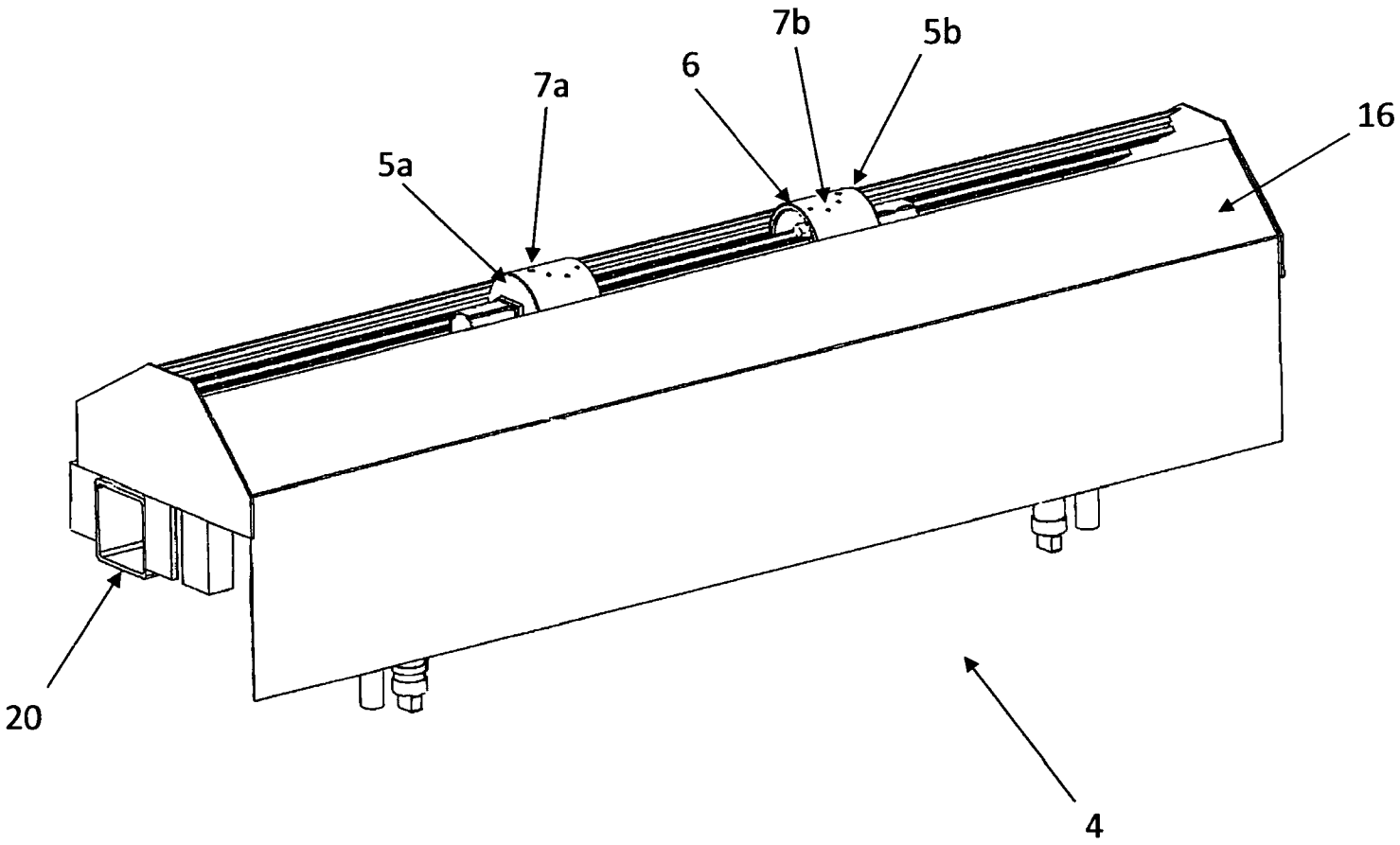
Figure 6C:
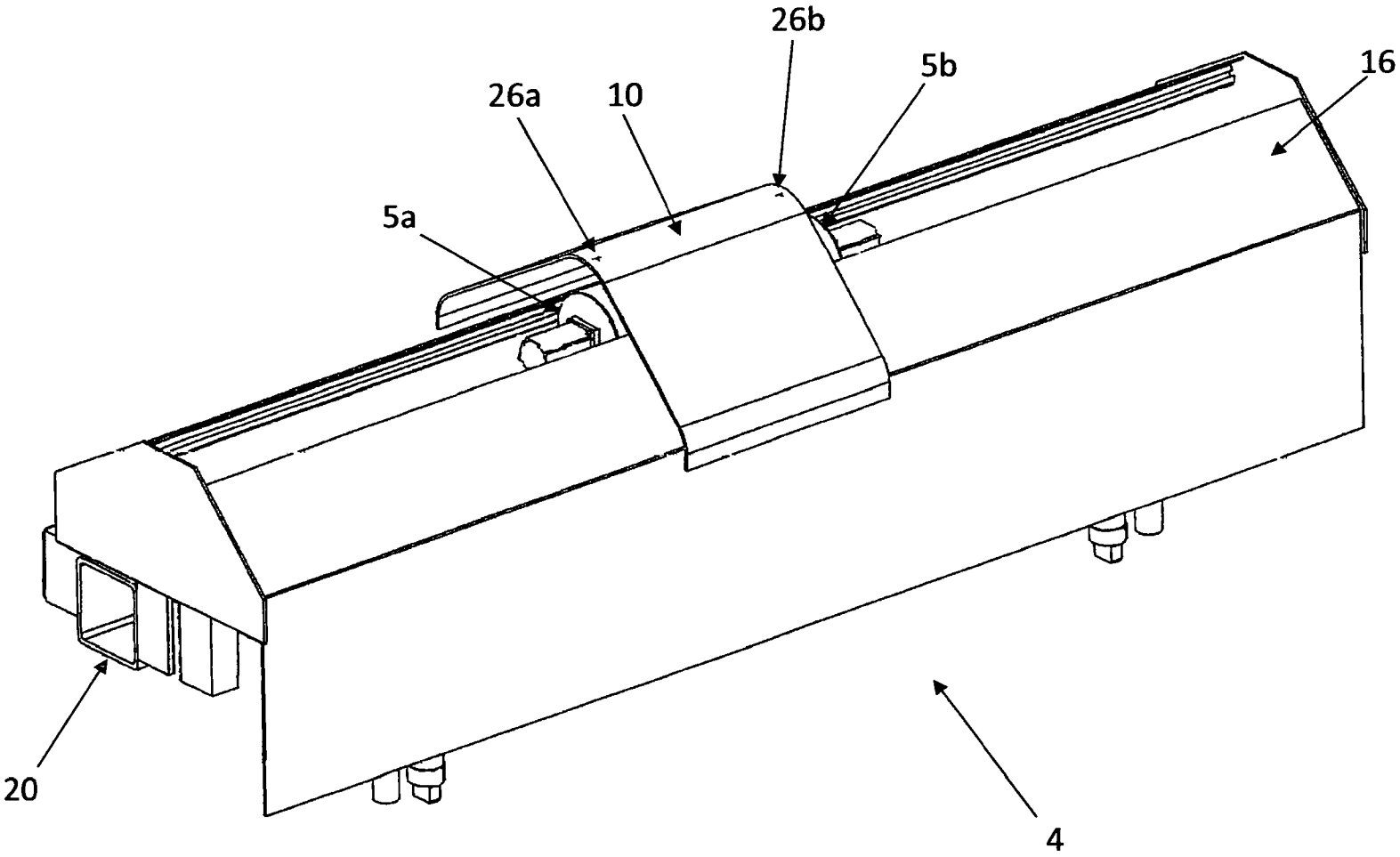
Figure 6D:
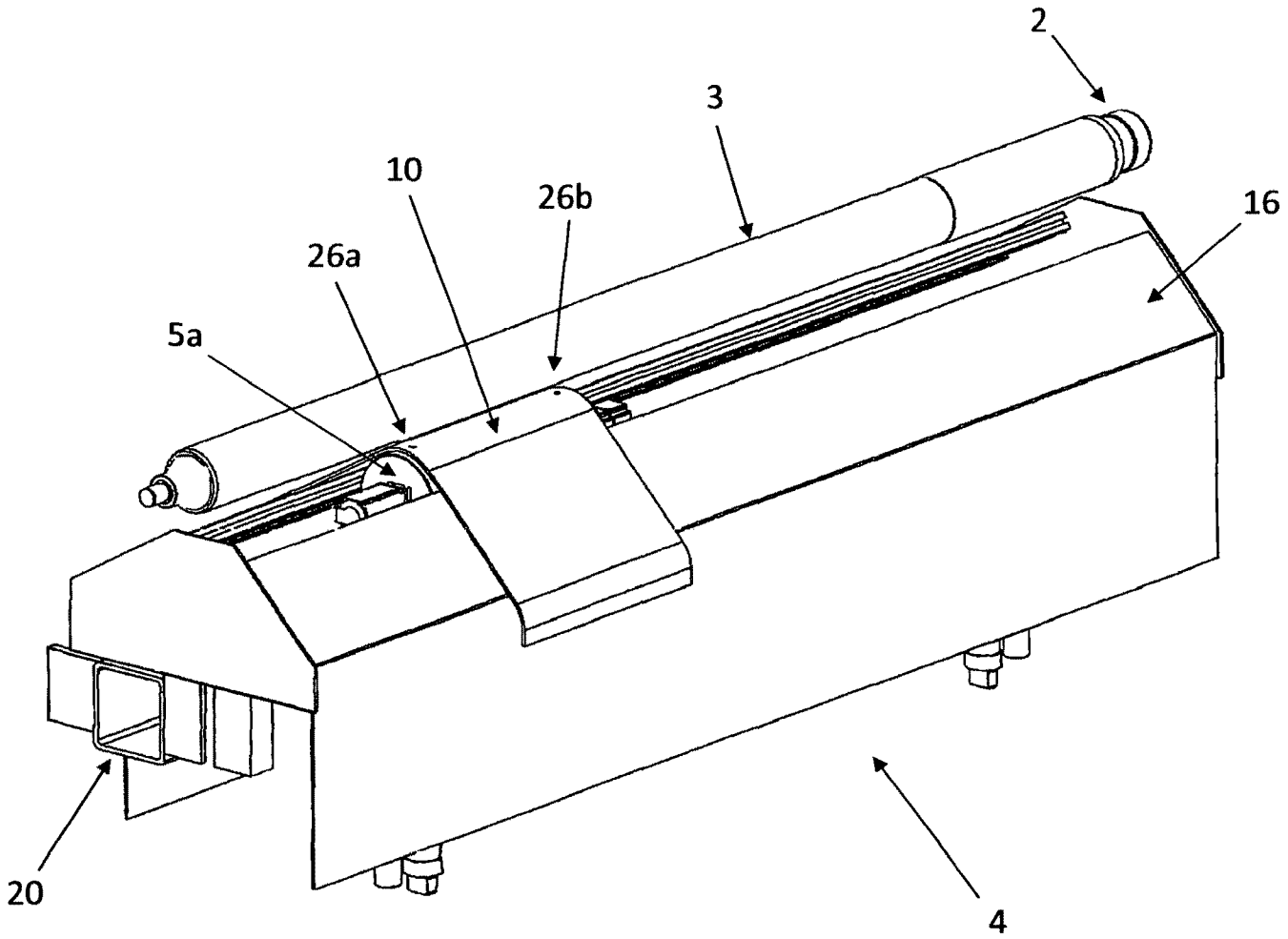
Figure 6E:
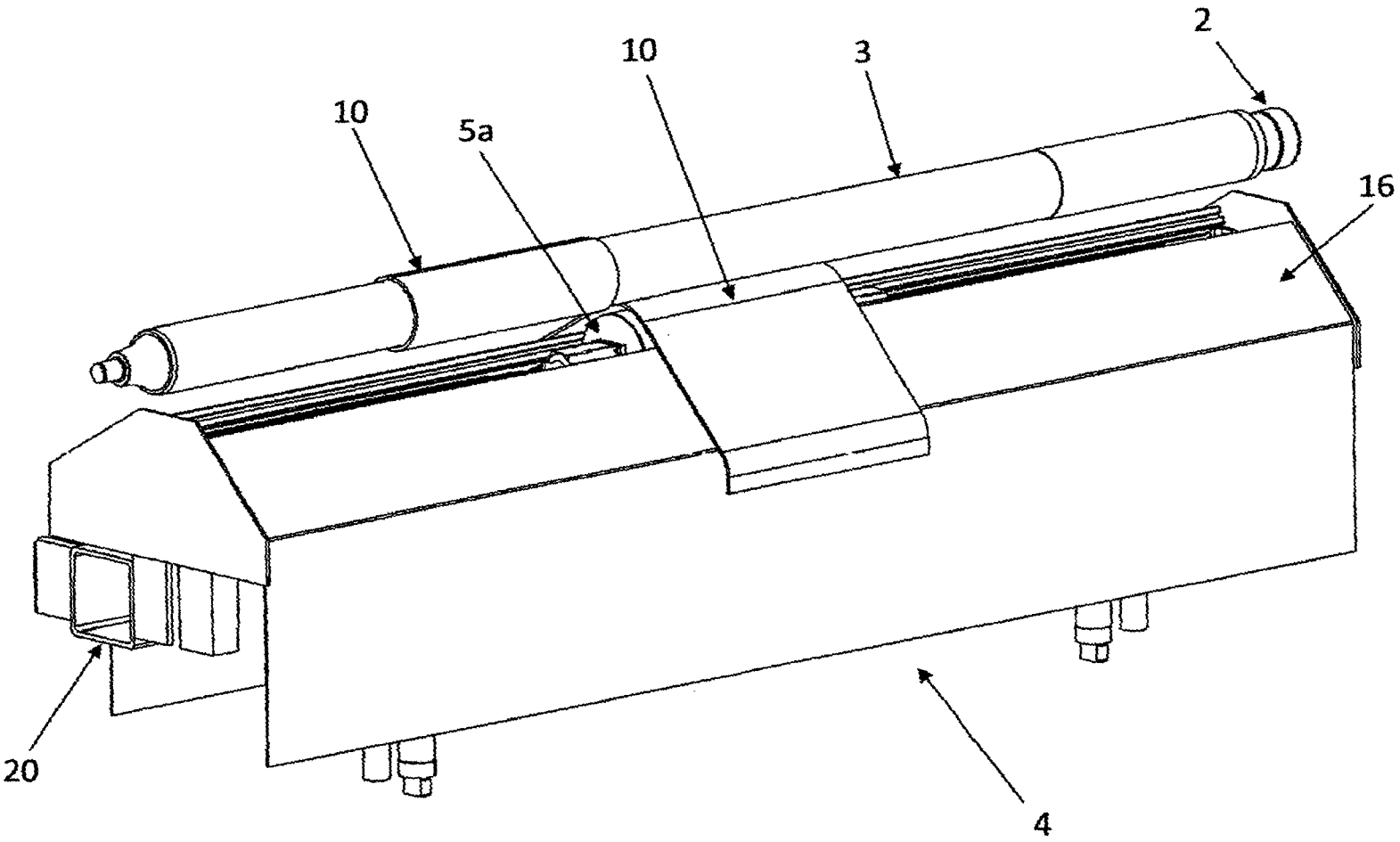
Figure 6F:
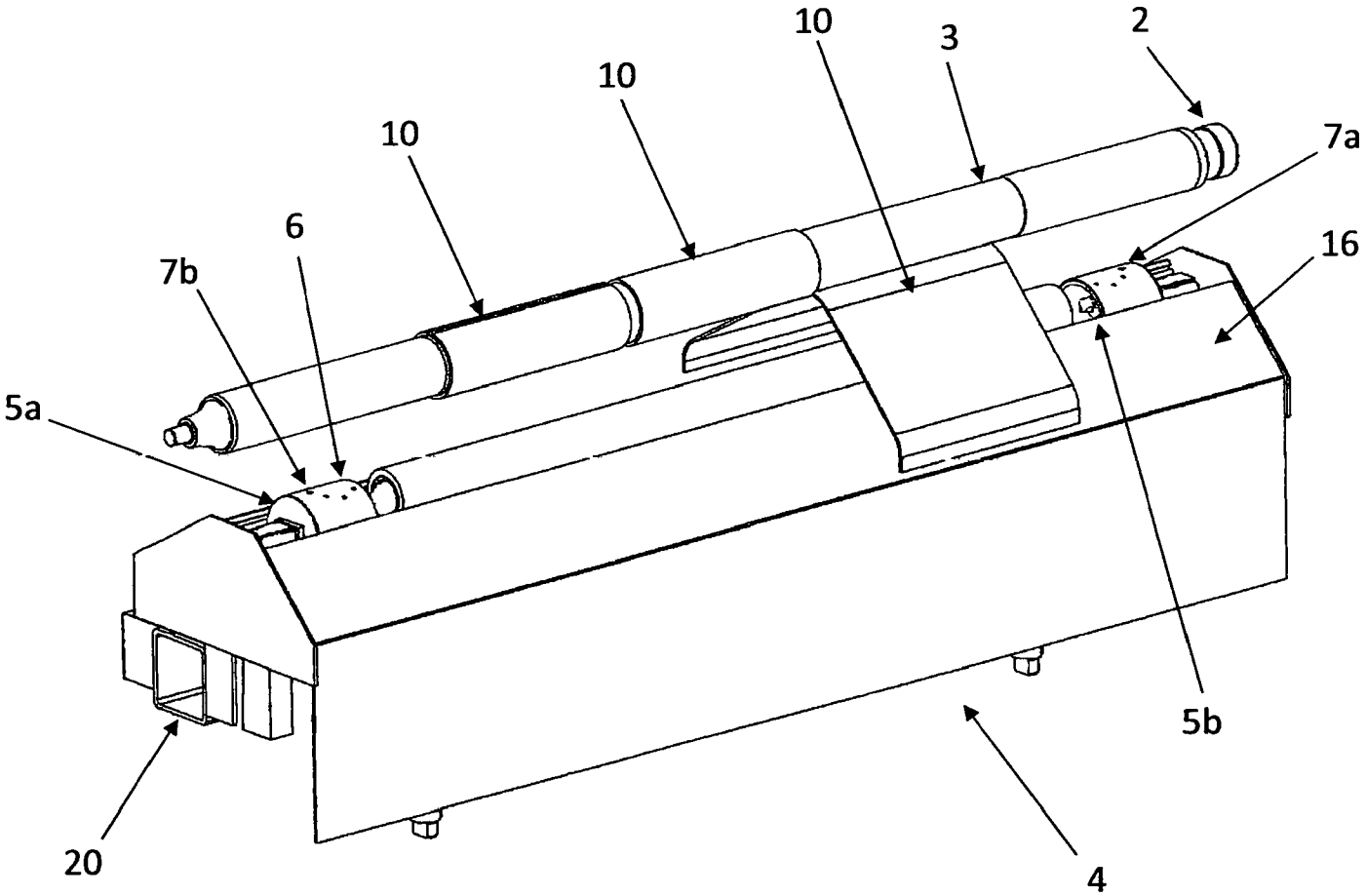
Figure 6G:
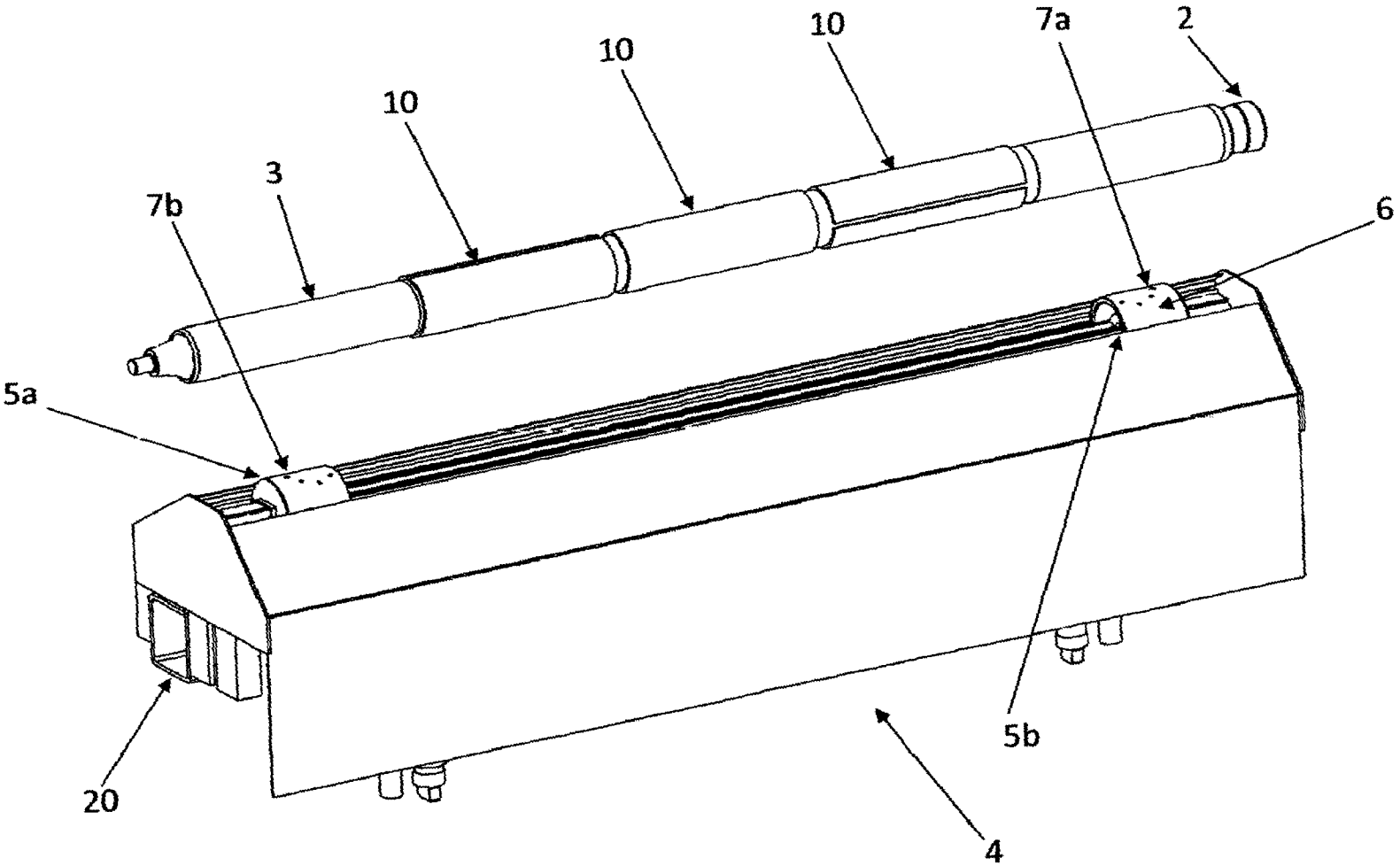

FIG. 6A shows the manipulator deck 4. The manipulator units 5*a*, 5*b* are located in their park positions at opposite ends of the manipulator deck 4. Each manipulator unit 5*a*, 5*b* has a motor (not shown) for moving the manipulator units 5*a*,5*b* in an axial direction during positioning and mounting operations. As shown in FIG. 6B, the manipulator units are centralised and positioned at theoretical target positions prior to applying the flexible plate 10 over the manipulator units 5*a*,5*b*. The flexible plate 10 is then inverted and draped over the manipulator units 5*a*,5*b* thereby forcing the flexible plate 10 into an arched profile (FIG. 6C). The manipulator deck 4 having a substantially curved profile provides additional support and helps maintain the arched profile of the flexible plate 10. The flexible plate 10 comprises two registration marks (26*a*, 26*b*) along its centre line. The locations of the registration marks (26*a*, 26*b*) are pre-programmed into a video recognition control system (not shown). Each manipulator unit 5*a*,5*b* is then independently controlled by a computer program to seek and find the registration marks (26*a*, 26*b*) on the inverted, arched flexible plate 10. The position of each manipulator unit 5*a*,5*b* may be adjusted axially as required, and for fine adjustments, the position of the support member 6 can also be adjusted in a radial direction. Once the program and/or operator is satisfied that the arched flexible plate 10 is appropriately aligned on the support members 6 of the manipulator units 5*a*,5*b* (by software or visual inspection of the display screen 8) a vacuum may be applied in order to temporarily secure the arched flexible plate 10 to the surface of the support member 6. A vacuum suction device 13 mounted below the support member 6 is suitable for this purpose. The video recognition control system is also pre-programmed with one or more axial positions for accurately aligning the arched flexible plate 10 with the sleeve 3 prior to the mounting operation. As best shown in FIG. 6D, the manipulator units 5*a*,5*b* together transport the arched flexible plate 10 to a first axial position below mandrel 2 onto which sleeve 3 has been mounted. Then, the manipulator deck 4 is moved into a raised position (FIG. 5) until contact is made between a first part of the arched flexible plate 10 and double sided adhesive tape (not shown) provided on sleeve 3. The vacuum is subsequently turned off and the manipulator deck 4 is lowered allowing the manipulator units 5*a*,5*b* to return to their respective parked positions at opposite ends of the manipulator deck 4. The roller 18 is thereafter raised, appropriately aligned and brought into contact with the centre line of the flexible plate 10. The roller 18 comprises a rubber surface layer which enables an even pressure to be applied to the surface of the flexible plate 10 as the flexible plate 10 is rolled onto the sleeve 3. This ensures that air pockets are not formed between the flexible plate 10 and the sleeve 3 during the mounting operation. The mandrel 2, which is a motor driven rotatable air mandrel, is then rotated in a first direction to wrap one end of the flexible plate around the sleeve 3. To complete the mounting operation, the rotational direction of the mandrel 2 is reversed so as to wrap the other end of the flexible plate 10 around the sleeve 3. Following its programmed path, the roller 18 is retracted back to its park position and the manipulator units 5*a*,5*b* with their cameras 14 return to their first axial positions in order to assess whether the position of the mounted flexible plate 10 corresponds with the programmed position. The automated system may thereafter advise the operator of any differences in the mounted and programmed positions. The process is repeated as shown best in FIGS. 6E-6G until the sleeve 3 is fully mounted with the required number of plates 10, in this case three. The sleeve 3 with flexible plates 10 mounted thereon is removed from the mandrel 2 and replaced by a new sleeve 3 for mounting further flexible plates 10 as required.

FIG. 7 shows a perspective view of the plate positioning and mounting apparatus 1 which has been provided with plate support wings 27*a*, 27*b*. In this embodiment a rectangular body 28 is integrally formed with and extends between the two plate support wings 27*a*, 27*b*. Each support wing 27*a*, 27*b* comprises a dimpled surface 29 and is adapted to follow the profile of the radially inwardly extending deck walls 16. As best shown in FIG. 7, the lower portion of each wing 27*a*, 27*b* comprises raised dimples 29 in a regular layout. In use, the rectangular body 28 extends across the gap 17 defined by the radially inwardly extending walls 16 and is attached to a manipulator unit 5*a*,5*b* using suitable fastening means (not shown) so that the flexible wings are able to move with the manipulator unit. Such an arrangement ensures that the flexible plate 10 experiences reduced frictional drag from the surface of the manipulator deck walls 16 as the flexible plate 10 is transported from one end of the apparatus 1 to a mounting position below the print sleeve 3. The above embodiment is described by way of example only. Many variations are possible without departing from the scope of the invention as defined in the appended claims.

The invention claimed is:

1. An apparatus for mounting a flexible plate onto a print sleeve or cylinder, wherein the apparatus comprises at least two manipulator units located below the print sleeve or cylinder and support members provided on each manipulator unit, wherein each support member has a curved profile for arching the flexible plate prior to its mounting onto the print sleeve or cylinder each manipulator unit comprises a camera operatively connected to a display screen, said camera being oriented upwards for viewing registration marks present on the flexible plate, and wherein each manipulator unit is adjustable in an axial direction and/or a radial direction.

2. Apparatus according to claim 1, wherein the apparatus comprises a manipulator deck having a substantially curved profile for providing additional support to the arched flexible plate.

3. Apparatus according to claim 2, wherein at least part of the manipulator deck comprises a dimpled surface.

4. Apparatus according to claim 2, wherein the manipulator deck comprises a motor for moving the manipulator deck between lowered and raised positions in a direction perpendicular to the axis of the print sleeve or cylinder.

5. Apparatus according to claim 1, wherein each support member comprises one or more apertures.

6. Apparatus according to claim 1, wherein each manipulator unit comprises vacuum means for temporarily securing the flexible plate to the surface of the support member.

7. Apparatus according to claim 1, wherein each manipulator unit is independently controllable.

8. Apparatus according to claim 1, wherein the apparatus comprises a roller for rolling the flexible plate onto the print sleeve or cylinder.

9. Apparatus according to claim 1, wherein each manipulator unit comprises plate support wings.

10. Apparatus according to claim 9, wherein at least part of the plate support wing comprises a dimpled surface.

11. Method for mounting a flexible plate onto a print sleeve or cylinder, the method comprising the steps of:

providing a print sleeve or cylinder;

providing a flexible plate having a relief surface;

applying the flexible plate onto at least two support members mounted on respective manipulator units, wherein the relief surface of the flexible plate faces the support members and wherein the support members are located below the print sleeve or cylinder and have a curved profile for arching the flexible plate;

adjusting the position of each manipulator unit axially and/or radially to align the manipulator units with registration marks present on the arched flexible plate;

aligning the arched flexible plate with the print sleeve or cylinder, and mounting the flexible plate onto the print sleeve or cylinder.

12. Method according to claim 11, wherein the step of aligning each manipulator unit with the registration marks on the arched flexible plate is an automated process and/or confirmed by visual inspection.

13. Method according to claim 11, wherein the manipulator units together move the arched flexible plate to a first mounting position below the print sleeve or cylinder.

14. Method according to claim 13, wherein the manipulator units are moved to a first mounting position below the print sleeve or cylinder before the flexible plate is applied onto the support members.

15. Method according to claim 13, wherein a first part of the flexible plate is brought into the print sleeve or cylinder by moving the manipulator units in a direction perpendicular to the axis of the print sleeve or cylinder until contact between the first part of the flexible plate and the print sleeve or cylinder is made.

16. Method according to claim 11, wherein the flexible plate is mounted onto the print sleeve or cylinder using a roller which rolls the flexible plate onto the print sleeve or cylinder.

17. An apparatus for mounting a flexible plate onto a print sleeve or cylinder, wherein the apparatus comprises at least two manipulator units located below the print sleeve or cylinder and support members provided on each manipulator unit, wherein each support member has a curved profile for arching the flexible plate prior to its mounting onto the print sleeve or cylinder, wherein each manipulator unit comprises a camera operatively connected to a display screen, said camera being oriented upwards for viewing registration marks present on the flexible plate.

18. An apparatus for mounting a flexible plate onto a print sleeve or cylinder, wherein the apparatus comprises at least two manipulator units located below the print sleeve or cylinder and support members provided on each manipulator unit, wherein each manipulator unit comprises plate support wings and wherein at least part of the plate support wing comprises a dimpled surface;

each support member has a curved profile for arching the flexible plate prior to its mounting onto the print sleeve or cylinder, and wherein each manipulator unit is adjustable in an axial direction and/or a radial direction.

* * * * *